US010910712B2

(12) United States Patent
Washakowski et al.

(10) Patent No.: US 10,910,712 B2
(45) Date of Patent: Feb. 2, 2021

(54) ACTIVE ELECTRONICALLY SCANNED ARRAY (AESA) ANTENNA CONFIGURATION FOR SIMULTANEOUS TRANSMISSION AND RECEIVING OF COMMUNICATION SIGNALS

(71) Applicant: RAYTHEON COMPANY, Waltham, MA (US)

(72) Inventors: Steven Washakowski, Franklin, MA (US); James A. Renfro, Upton, MA (US); Gary T. Follett, Oakland, RI (US)

(73) Assignee: Raytheon Company, Waltham, MA (US)

( * ) Notice: Subject to any disclaimer, the term of this patent is extended or adjusted under 35 U.S.C. 154(b) by 17 days.

(21) Appl. No.: 16/247,405

(22) Filed: Jan. 14, 2019

(65) Prior Publication Data

US 2020/0227826 A1 Jul. 16, 2020

(51) Int. Cl.

| | |
|---|---|
| ***H01Q 3/34*** | (2006.01) |
| ***H01Q 3/26*** | (2006.01) |
| ***H01Q 3/30*** | (2006.01) |
| ***H01Q 21/20*** | (2006.01) |
| ***H01Q 21/22*** | (2006.01) |
| *H01Q 1/32* | (2006.01) |
| *H01Q 1/12* | (2006.01) |
| *H01Q 1/28* | (2006.01) |

(52) U.S. Cl.

CPC ..... *H01Q 3/34* (2013.01); *H01Q 3/26* (2013.01); *H01Q 3/30* (2013.01); *H01Q 21/205* (2013.01); *H01Q 21/22* (2013.01); *H01Q 1/1228* (2013.01); *H01Q 1/282* (2013.01); *H01Q 1/3275* (2013.01)

(58) Field of Classification Search

CPC ..... H01Q 3/22; H01Q 3/46

See application file for complete search history.

(56) References Cited

U.S. PATENT DOCUMENTS 5,414,433 A * 5/1995 Chang ..... H01Q 3/22 342/372

5,552,798 A * 9/1996 Dietrich ..... H01Q 1/288 343/893

(Continued)

FOREIGN PATENT DOCUMENTS

EP 2720317 B1 1/2018

OTHER PUBLICATIONS

International Search Report for corresponding International Application No. PCT/US2019/057915, filed Oct. 24, 2019, International Search Report dated Jan. 7, 2020 and dated Jan. 17, 2020 (5 pgs.).

(Continued)

*Primary Examiner* — Ab Salam Alkassim, Jr.

(74) *Attorney, Agent, or Firm* — Lewis Roca Rothgerber Christie LLP

(57) ABSTRACT

An AESA antenna configuration for simultaneous transmission and receiving of communication signal includes: a housing having eight sides; four transmit sides and four receive sides alternating there between and forming a 45 degree angle with their respective neighbor sides, where cross sections of the housing in a plane perpendicular to a vertical axis of the housing are tapered from a top to a bottom of the housing in the vertical direction by a cant angle.

18 Claims, 7 Drawing Sheets

(56) References Cited

U.S. PATENT DOCUMENTS 5,686,926 A * 11/1997 Kijima ..... H01Q 25/00 342/373
5,736,959 A * 4/1998 Patterson ..... H01Q 1/242 342/354
5,969,689 A * 10/1999 Martek ..... H01Q 1/246 343/758
5,995,062 A * 11/1999 Denney ..... H01Q 1/1235 343/700 MS
6,061,562 A * 5/2000 Martin ..... H01Q 3/242 455/431
6,172,654 B1 * 1/2001 Martek ..... H01Q 1/246 342/375
6,323,823 B1 * 11/2001 Wong ..... H01Q 1/246 343/844
6,693,971 B1 * 2/2004 Kowalski ..... H04B 15/00 375/285
7,015,871 B2 * 3/2006 Gottl ..... H01Q 1/246 343/757
8,334,809 B2 * 12/2012 Nichols ..... H01Q 1/3275 343/700 MS
8,525,729 B1 * 9/2013 Martin ..... H01Q 21/061 343/700 MS
9,244,155 B2 * 1/2016 Bielas ..... G01S 7/006
2001/0050634 A1 * 12/2001 Laidig ..... H01Q 3/242 343/7 MS
2003/0095077 A1 * 5/2003 Livadiotti ..... H01Q 1/005 343/890
2010/0099370 A1 * 4/2010 Nichols ..... H01Q 21/20 455/129
2012/0200449 A1 * 8/2012 Bielas ..... H01Q 1/281 342/62
2015/0122886 A1 * 5/2015 Koch ..... H01Q 9/0407 235/440
2015/0288438 A1 * 10/2015 Maltsev ..... H01Q 21/205 455/101
2015/0365955 A1 * 12/2015 Liu ..... H04W 52/16 370/329
2017/0104276 A1 * 4/2017 Vacanti ..... H01Q 1/28
2017/0160389 A1 * 6/2017 Vacanti ..... H01Q 1/525
2017/0324162 A1 * 11/2017 Khachaturian ..... H01Q 21/065
2017/0338558 A1 * 11/2017 West ..... H01Q 3/2682
2018/0269586 A1 * 9/2018 Kawahata ..... H01Q 15/08
2019/0028159 A1 * 1/2019 Bisiules ..... H01Q 1/246
2019/0310347 A1 * 10/2019 Harman ..... G01S 7/415

OTHER PUBLICATIONS

Written Opinion of the International Searching Authority for corresponding International Application No. PCT/US2019/057915, filed Oct. 24, 2019, Written Opinion of the International Searching Authority dated Jan. 17, 2020 (13 pgs.).

* cited by examiner

ACTIVE ELECTRONICALLY SCANNED ARRAY (AESA) ANTENNA CONFIGURATION FOR SIMULTANEOUS TRANSMISSION AND RECEIVING OF COMMUNICATION SIGNALS

FIELD OF THE INVENTION

The present invention relates generally to communication systems and more specifically to concurrent bidirectional communication of signals within the same frequency band.

BACKGROUND

An antenna array is a group of multiple connected antennas coupled to a common source or load to act as a single antenna and produce a directive radiation pattern. Usually, the spatial relationship of the individual antennas also contributes to the directivity of the antenna array. A phased array antenna is an array of antennas in which the relative phases or time delays of the signals feeding the antennas are varied in a manner that the effective radiation pattern of the entire array is reinforced in a desired direction and suppressed in undesired directions.

FIG. 1 shows a diagram of a conventional antenna array 100. The antenna array 100 includes several linear arrays 104 housed in a (non-metallic) radome 102. Here, each linear array 104 is arranged vertically with spacing between each other, which is determined by the wavelength of the desired operating frequency of the antenna array 100. Each linear array 104 is connected to its associated radio frequency (RF) electronics circuitry contained in an external RF electronics module 108, via an antenna feed 106. The RF electronics module 108 is connected to external systems via a connection 110 for power, control, and communications connections; and may be physically mounted within the radome 102, or may be located remotely or outside of the antenna array 100.

An Electronically Scanned Array (ESA) is a type of phased array antenna, in which transceivers include a large number of solid-state transmit/receive modules. In ESAs, an electromagnetic beam is emitted by broadcasting radio frequency energy that interferes constructively at certain angles in front of the antenna. An active electronically scanned array (AESA) is a type of phased array antenna whose transmitter and receiver (transceiver) functions are composed of numerous small solid-state transmit/receive modules (TRMs) or components. AESA antennas aim their beam by emitting separate radio waves from each module that interfere constructively at certain angles in front of the antenna.

Typically, the basic building block of a conventional AESA is the Transmit/Receive module or TR module, which can be packaged to form an AESA antenna element, and may include a radiator, receiver Low Noise Amplifier (LNA), transmit Power Amplifier (PA), and digitally controlled phase or delay and gain components. Several of these TR modules are placed on antenna panels in a grid format for transmitting and receiving communication signals. Digital control of the transmit/receive gain and phase allows an AESA antenna to steer or point the resultant antenna beam without physically moving the antenna panel. Typical modern day low cost communications AESA antenna panels employ printed circuit radiators connected to surface mount Monolithic Microwave Integrated Circuit (MMIC) devices that contain the LNA, PA and phase/gain control circuitry, all on a single printed circuit board (PCB).

The ability to transmit and receive from the same AESA antenna panel is typically governed by the operational scenario of the antenna, and provides satisfactory performance for half-duplex operation (i.e., separate time slots for transmit and receive), or with significant operational frequency separation between the transmitter and the receiver. For full-duplex operation and simultaneous transmission and reception of signals within the same frequency band, individual antenna panels for transmitting and for receiving are typically utilized and physically separated by some distance to avoid co-site interference (signals from the transmit antenna coupling into the receive antenna and interfering with the reception of the desired signal).

Additionally, a single AESA antenna panel has practical limitations in scan angle in both azimuth and elevation in its ability to steer or form a beam. Beam shape and signal strength both degrade as the beam is steered away from an antenna panel normal vector (or boresight) to the scan angle edges, typically by +/−60 degrees from normal. Therefore, supporting communications in any direction around a circle with the radio platform at the center requires either the AESA antenna panel to physically move or rotate, or multiple AESA antenna panels spaced about the circle to provide 360 degrees of coverage. Rotating the antenna panel is a satisfactory solution in the single link scenario where there is only one direction in which the antenna must point. It does however become unacceptable for the multi-link cases where multiple simultaneous links can be established in any direction from the radio platform.

A further desirable and beneficial feature of the AESA antenna panel is that it can be designed to support multiple simultaneous beams or communication links from a single panel. This is realized by integrating multiple separate channel paths within the MMIC devices connected to the same printed circuit radiators.

In the case of a hub station, relay station or tower configuration (either a mobile hub or a stationary hub servicing mobile users), the antenna array must support multiple communication links arriving at any direction around the circle with the station in the center. This antenna array can be formed with multiple AESA antenna panels capable of each supporting multiple beams or links. While three antenna panels or "faces" of the antenna array can be used with +/−60 degrees of scan (120 degrees each face) to cover the entire 360 degree circle, four faces provide some overlap between coverage zones to allow for link handover from one antenna to the adjacent antenna as the platforms move relative to one another.

However, this conventional antenna array configuration is bulky and inflexible. In many applications, including aircrafts, an airborne antenna subsystem is needed to support multiple simultaneous transmit and receive beams in a compact aerodynamic mechanical configuration. This requires being able to place the transmit and receive AESA antenna panels as close as possible together within the same antenna array assembly.

SUMMARY

In some embodiments, the disclosed embodiments are directed to a compact AESA antenna array providing multi-beam simultaneous transmit and receive operation with hemispherical coverage and co-site interference mitigation through placement of transmit and receive antenna panels relative to each other in the same assembly.

In some embodiments, the disclosed invention is an active electronically scanned array (AESA) antenna configuration for simultaneous transmission and receiving of communication signals. The antenna configuration includes: a housing having eight sides; a first transmit AESA panel including transmit electronic circuitry mounted on a first side of the housing; a first receive AESA panel including receive electronic circuitry mounted on a second side of the housing adjacent to the first transmit AESA panel and forming an angle of about 45 degrees with the first transmit AESA panel; a second transmit AESA panel including transmit electronic circuitry mounted on a third side of the housing adjacent to the first receive AESA panel and forming an angle of about 45 degrees with the first receive AESA panel; a second receive AESA panel including receive electronic circuitry mounted on a fourth side of the housing adjacent to the second AESA transmit panel and forming an angle of about 45 degrees with the second AESA transmit panel; a third transmit AESA panel including transmit electronic circuitry mounted on a fifth side of the housing adjacent to the second AESA receive panel and forming an angle of about 45 degrees with the second AESA receive panel; a third receive AESA panel including receive electronic circuitry mounted on a sixth side of the housing adjacent to the third transmit AESA panel and forming an angle of about 45 degrees with the third AESA transmit panel; a fourth transmit AESA panel including transmit electronic circuitry mounted on a seventh side of the housing adjacent to the third receive AESA panel and forming an angle of about 45 degrees with the third receive AESA panel; and a fourth receive AESA panel including receive electronic circuitry mounted on an eight side of the housing adjacent to the fourth transmit AESA panel and the first transmit AESA panel, and forming an angle of about 45 degrees with fourth transmit AESA panel and the first transmit AESA panel at a respective side thereof, where each of the transmit and receive AESA panels are tilted by a cant angle with respect to a vertical axis of the antenna configuration.

In some embodiments, the disclosed invention is an active electronically scanned array (AESA) antenna configuration for simultaneous transmission and receiving of communication signals. The antenna configuration includes: a housing having six sides; a first transmit AESA panel including transmit electronic circuitry mounted on a first side of the housing; a first receive AESA panel including receive electronic circuitry mounted on a second side of the housing adjacent to the first transmit AESA panel and forming an angle of about 60 degrees with the first transmit AESA panel; a second transmit AESA panel including transmit electronic circuitry mounted on a third side of the housing adjacent to the first receive AESA panel and forming an angle of about 60 degrees with the first receive AESA panel; a second receive AESA panel including receive electronic circuitry mounted on a fourth side of the housing adjacent to the second transmit AESA panel and forming an angle of about 60 degrees with the second transmit AESA panel; a third transmit AESA panel including transmit electronic circuitry mounted on a fifth side of the housing adjacent to the second receive AESA panel and forming an angle of about 60 degrees with the second receive AESA panel; and a third receive AESA panel including receive electronic circuitry mounted on a sixth side of the housing adjacent to the third transmit AESA panel and forming an angle of about 60 degrees with the third transmit AESA panel and the first transmit panel at a respective side thereof, wherein each of the transmit and receive AESA panels are tilted by a cant angle with respect to a vertical axis of the antenna configuration.

The cant angle may be in a range of 0 to 45 degrees to form a cone-shaped housing having a tapered cross section from the top to the bottom in the vertical direction.

BRIEF DESCRIPTION OF THE DRAWINGS

These and other features, aspects, and advantages of the present invention will become better understood with regard to the following description, appended claims, and accompanying drawings.

DETAILED DESCRIPTION

In some embodiments, the disclosed invention is a compact physical arrangement of both communication transmit and receive antenna panels simultaneously operating in the same frequency band and providing multi-beam, hemispherical coverage and co-site interference mitigation. In some embodiments, the antenna panel assembly comprises an octagonal (or hexagonal) cone array housing which provides four (or three) panels of (for example, Ku-Band) transmit panels including related transmit electronic circuitry and four (or three) panels of (for example, Ku-Band) receive panels including related receive electronic circuitry, where the transmit and receive panels alternate in their placement and therefore no transmit panel is adjacent to another transmit panel and no receive panel is adjacent to another receive panel on a different face of the housing. Each receive panel is offset from its adjacent transmit panel by about 45 degrees in the case of octagonal or 60 degrees in the case of hexagonal array (plus-minus the manufacturing calibration or offset errors) to form the generally octagonal (or hexagonal) cone shape and reduce co-site interferences.

Each of the eight (or six) faces (sides) of the configuration is canted by the same angle (for example, 0-45 degrees) from a vertical axis of the assembly from its top to its bottom to provide full hemispherical coverage for the platform to which the antenna panel assembly is mounted. This way, the cross sections of the octagonal cone array housing in planes perpendicular to the vertical axis, are tapered from top (depicted in FIGS. 2A and 2B) to the bottom of the housing.

The eight sides of the cone assembly alternate between transmit and receive antenna panels. The alternating transmit and receive antenna panels are offset by 45 degrees from each other and canted from the vertical axis provide a compact multi-beam antenna configuration which mitigate co-site interference and provide full hemispherical coverage. An AESA antenna array assembly design allows full hemispherical coverage using an array of individual AESA T/R antenna panels, each designed for maximum 60 degree scan angle from the normal line, by adding more panels and thus expanding the field of view to 360 degrees. In some embodiments, the size of the assembly is scalable based on operating frequency, number of beams required and scan capabilities of the individual antenna panels. For example, for higher frequency signals, the size of the individual AESA antenna panels may be reduced since the size of the panels is based on the spacing of the individual elements which is inversely proportional to the operating frequency. If the size of the AESA antenna panels that comprise the array assembly are reduced, then the overall size of the antenna array can be reduced accordingly.

Figure 1:
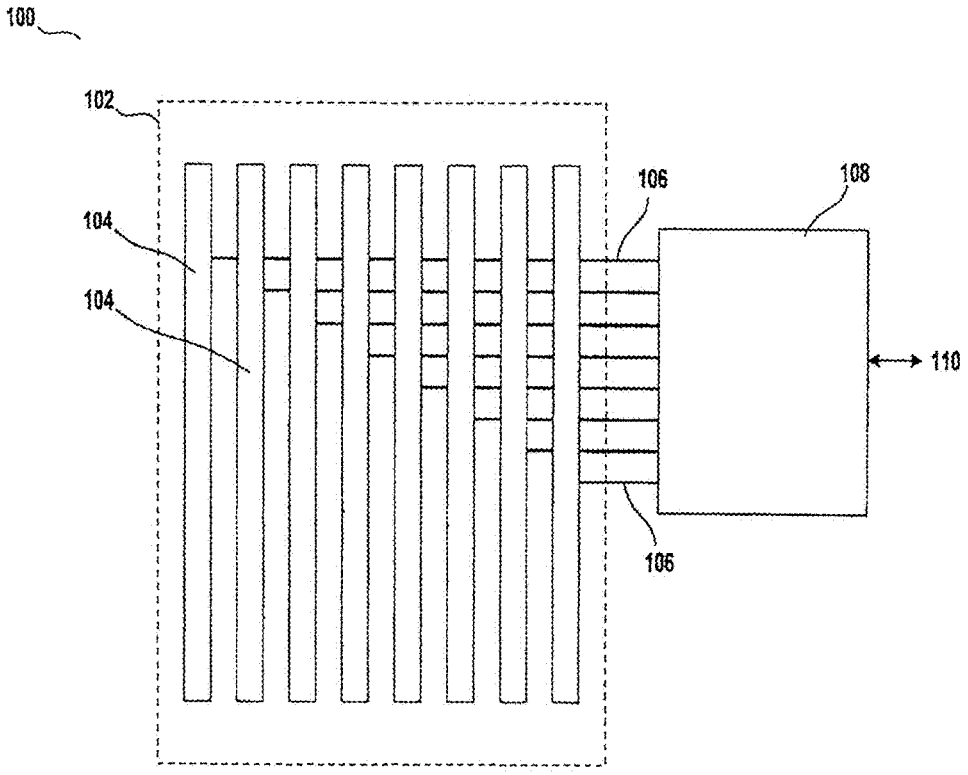
FIG. 1 (PRIOR ART)
FIG. 1 shows a diagram of a conventional antenna array.
Figure 2A:
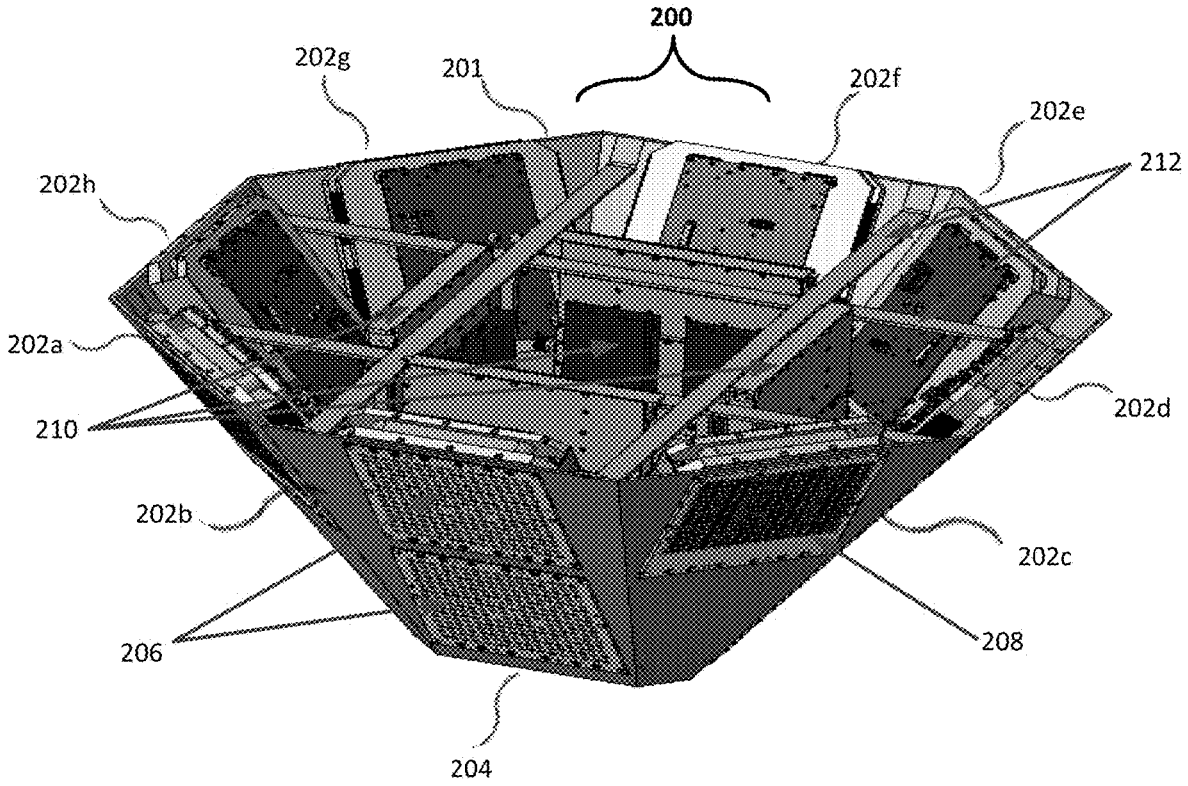
FIG. 2A depicts an exemplary AESA antenna array assembly, according to some embodiments of the disclosed invention.

FIG. 2A depicts an exemplary AESA antenna array assembly 200, according to some embodiments of the disclosed invention. As shown eight face panels (sides) 202*a*-202*h* are arranged in an octagonal shape at the top in an optional octagonal cone shaped housing 201 and are canted with respect to a vertical axis at an angle α (cant angle, shown in FIG. 2B), for example 15-30 degrees in this case, to form an octagonal shape at the bottom 204 of the assembly. In this example, face panels 202*a*, 202*c*, 202*e* and 202*g* are used for receive panels for receiving communication signals and include receive AESA panels 208 with related electronic circuitries. Likewise, face panels 202*b*, 202*d*, 202*f* and 202*h* are used for transmit panels for transmitting communication signals and include transmit AESA panels 206 with related electronic circuitries. As illustrated in FIG. 2A, the receive AESA panels 208 and the transmit AESA panels 206 alternate between one another to minimize interferences between the transmit and receive signals and form a 45 degree angle therebetween. This enables the antenna assembly 200 to transmit and receive signals simultaneously with minimum signal interference. If the scan capability of the antenna panels supports more than +/−60 degrees, the number of faces can be reduced accordingly, (e.g., a hexagon instead of an octagon) and the same hemispherical coverage can be achieved with a further improvement in transmit to receive isolation.

Although two transmit AESA panels 206 and one receive AESA panel 208 are shown on each transmit and receive face, respectively, one skilled in the art would recognize that the embodiments are not limited to this configuration and may have more or less than two AESA panels on each face. For example, each of the transmit and receive faces 202*a*-202*h* may have a plurality of transmit or receive AESA panels for simultaneous transmission or receiving of a plurality of communication signals. In some embodiments, the eight face panels 202*a*-202*h* are secured in the housing 201 by a frame 212, which is compact, sturdy and lightweight. In some embodiments, the panel and/or the housing is comprised of light material, such as Aluminum, polymer, carbon fiber, or any other structurally sound material or combination thereof.

Electronic circuitry, printed circuit board (PCB) and other peripheral components 210 of the AESA antenna array assembly 200 are accommodated inside of the housing 201, however, can be located elsewhere within the installation platform. In some embodiments, each of the transmit AESA panels 206 and receive AESA panels 208 are sized based on the desired operating frequency and scan angle/beam shape of the system, and can be combined in any desired configuration as long as the transmit and receive panels are configured on separate faces/sides and the AESA panels are offset by 45 degrees from one another.

Figure 2B:
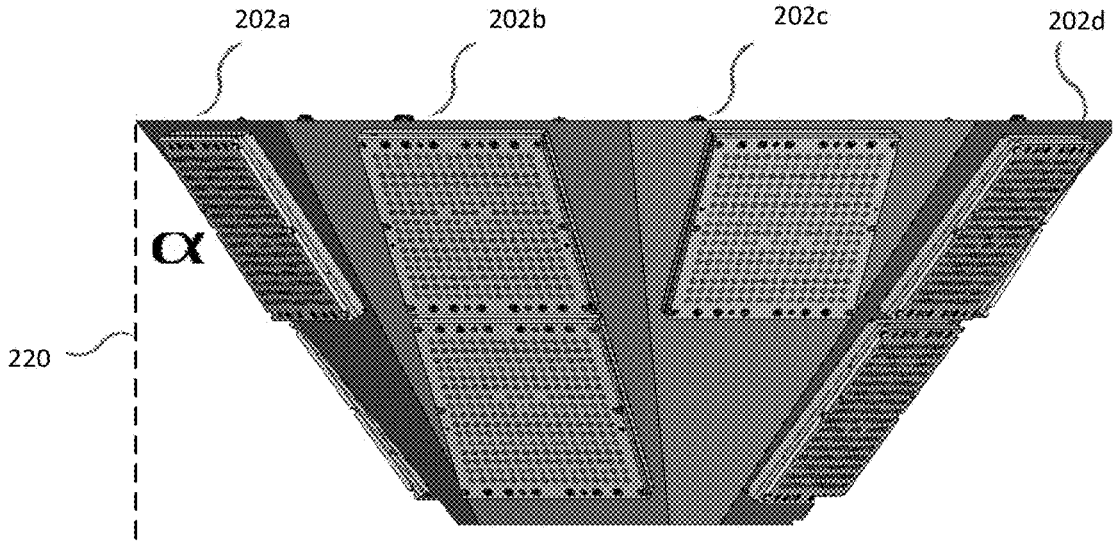
FIG. 2B illustrates a side view of the AESA antenna array assembly of FIG. 2A, according to some embodiments of the disclosed invention.

FIG. 2B depicts a side view of the AESA antenna array assembly 200, according to some embodiments of the disclosed invention. As shown each of the eight face panels 202*a*-202*h* (only four face panels 202*a*-202*d* are shown in FIG. 2B for simplicity reason) forms a cant angle α with a vertical axis 220. This cant angle represents the cant angle of the face panels and may be anywhere from zero degrees (no canting) up to 30 degrees or more. The cant angle allows for full hemispherical coverage for operation with an AESA antenna panel that has practical limitations on the elevation scan angle. For example in a ground based installation, an AESA panel with an elevation scan angle of +/−60 degrees and zero cant angle cannot scan the full field of view between the horizon (0 degrees) and directly above the antenna (90 degrees) since it only sees 0 to 60 degrees (lower scan angles would form a beam into the ground). Thus by canting the antenna face panels (and therefore the AESA panels) upwards, the antenna can scan the entire space between the horizon and the space directly above the antenna. In some embodiments, the cant angle is in a range of 0 to 45 degrees to form a cone-shaped housing having a tapered cross section from the top to the bottom in the vertical direction. In some embodiments, the housing is a frame similar to the frame depicted in FIG. 3B. In some embodiments, the housing is a structure similar to the structure shown in FIG. 3A.

Figure 3A:
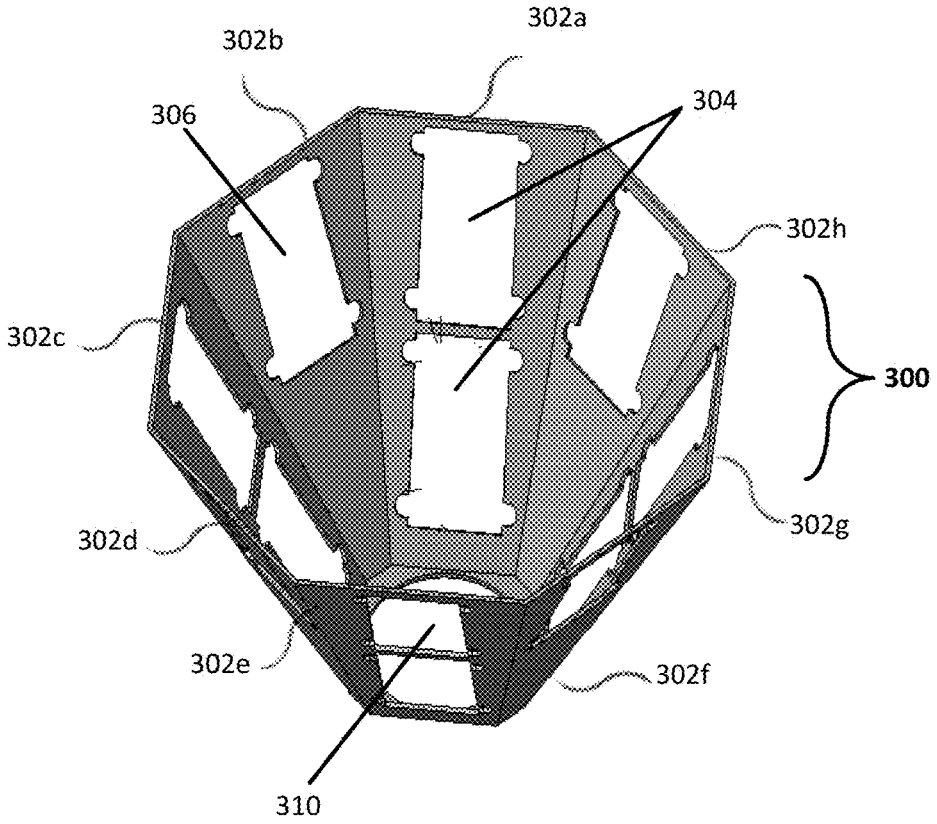
FIG. 3A shows an exemplary housing for an AESA antenna array assembly, according to some embodiments of the disclosed invention.

FIG. 3A shows an exemplary housing for an AESA antenna array assembly, according to some embodiments of the disclosed invention. A housing 300 forms the structure which holds the AESA antenna panels in place at the proper angles relative to each other and at the proper/desired cant angle. Each of the eight face panels of the housing are fastened together with transmit face panels 302*a*, 302*c*, 302*e* and 302*g* alternating with receive face panels 302*b*, 302*d*, 302*f* and 302*h*. The shape of the cutouts 304 and 306 is based upon the shape and configuration of the AESA panels to be installed, with the transmit AESA panel cutouts 304 in the transmit face and the receive AESA panel cutouts 306 in the receive face. The opening 310 at the bottom of the housing is optional and represents a potential mounting feature, an opening for wires and cables and/or location of possible maintenance hatch. In some embodiments, the shape of the opening 310, may be circular, elliptical, square or rectangular.

Figure 3B:
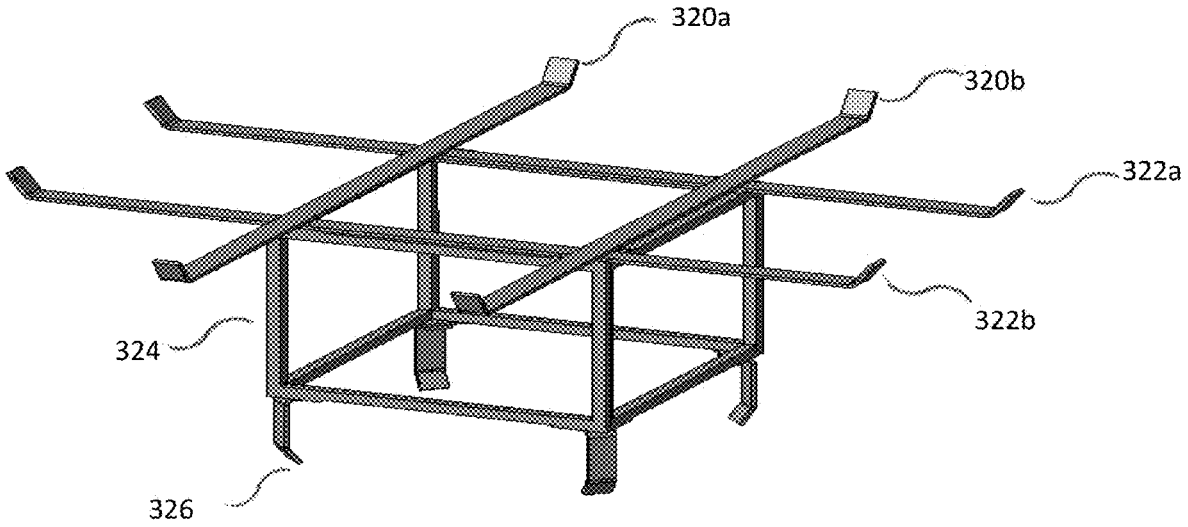
FIG. 3B shows an exemplary frame for an AESA antenna array assembly, according to some embodiments of the disclosed invention.

FIG. 3B shows an exemplary frame for an AESA antenna array assembly, according to some embodiments of the disclosed invention. The frame adds support to the AESA faces of the assembly and provides optional mounting structures 324 within the assembly for attaching peripheral electronics assemblies close to the AESA antenna panels. Structural members 320*a*, 320*b* and 322*a*, 322*b* support the top or larger opening while structural members 326 support the lower smaller opening. In some embodiments, the frame may replace the housing shown in FIG. 3A. In some embodiments, the frame is a trellis frame.

Figure 6A:
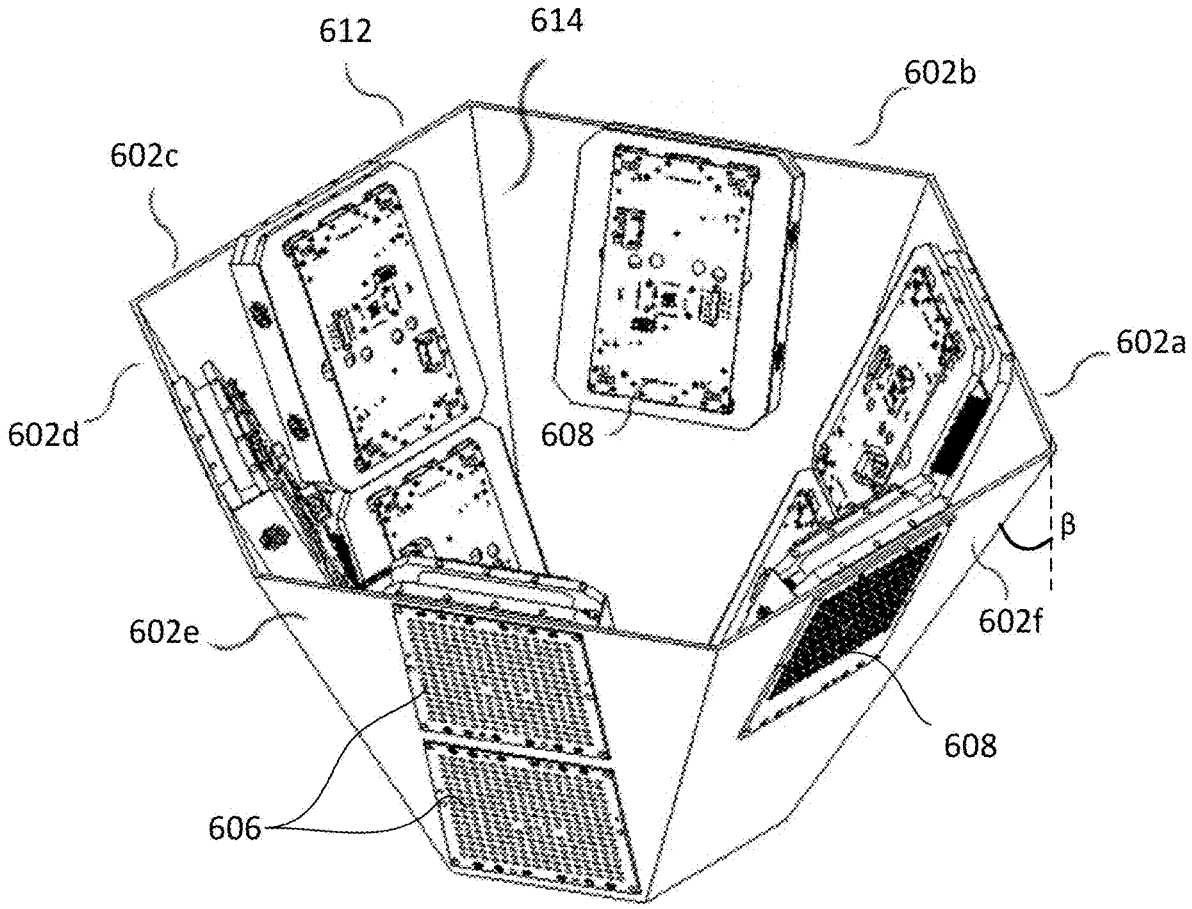
FIG. 6A depicts an exemplary AESA antenna array assembly, according to some embodiments of the disclosed invention.
Figure 6B:
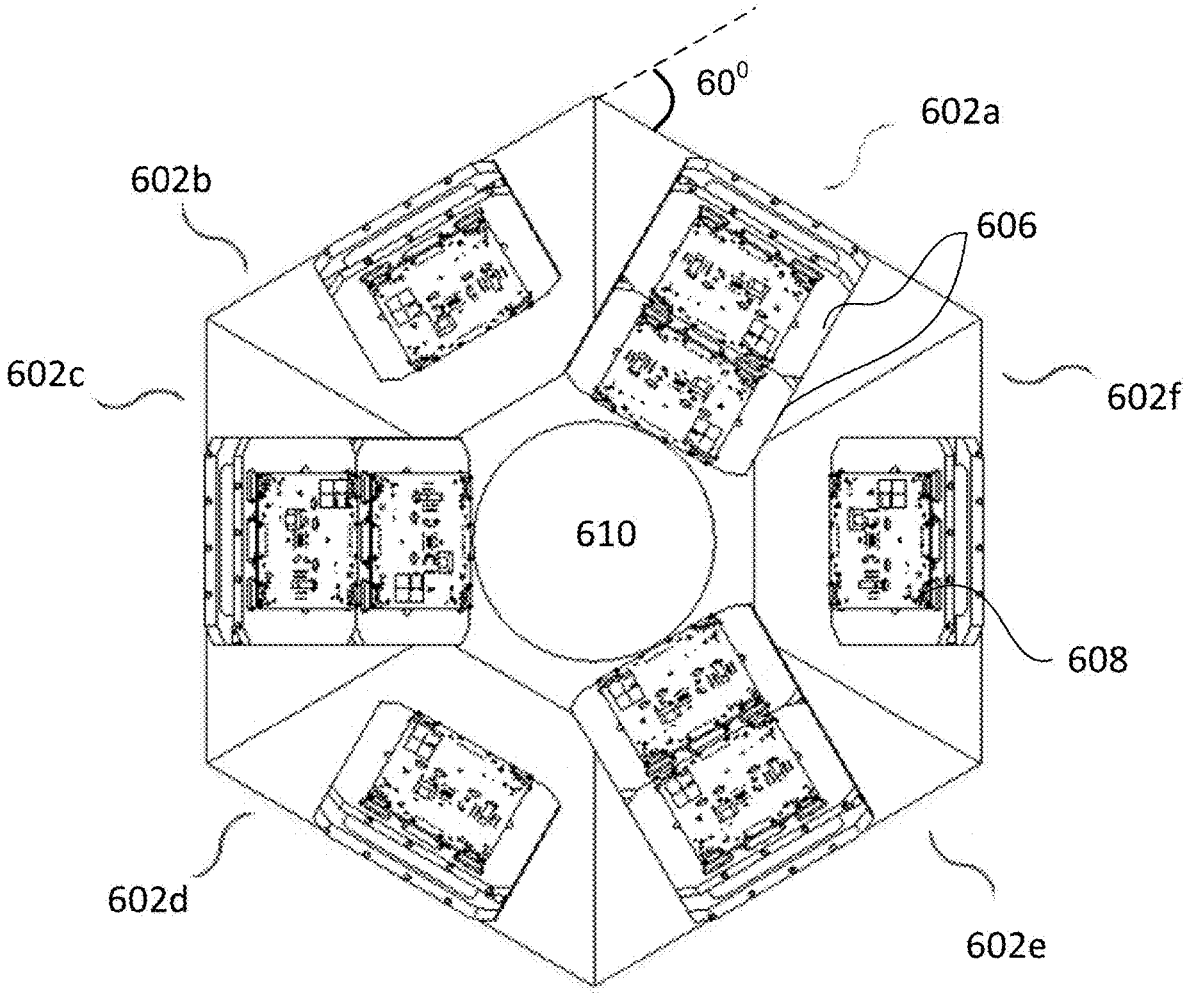
FIG. 6B illustrates a top view of the AESA antenna array assembly of FIG. 6A, according to some embodiments of the disclosed invention.

FIGS. 6A and 6B illustrate a side view and a top view of an exemplary AESA antenna array assembly, according to some embodiments of the disclosed invention. In the case that the scan capability of the antenna panels supports more than +/−60 degrees, a hexagonal cone array configuration will be able to provide full 360 degree multibeam coverage, which results in a smaller and lower cost antenna array. As shown six face panels 602*a*-602*f* are arranged in a hexagonal shape at the top in a hexagonal cone shaped housing and are canted with respect to a vertical axis at an angle β, for example 15-30 degrees in this case, to form a hexagonal shape at the top opening 612 and bottom opening 610 of the assembly. In this example, the three face panels 602*a*, 602*c* and 602*e* are used as transmit sides for transmitting communication signals and include transmit AESA panels with related electronic circuitries 606. Likewise, face panels 602*b*, 602*d* and 602*f* are used as receive sides for receiving communication signals and include receive AESA panels with related electronic circuitries 608. As illustrated in FIG. 6A and similar to FIG. 2A, the receive AESA panels and the transmit AESA panels alternate to minimize interferences between the transmit and receive signals, however, they form a 60 degree angle therebetween. This enables the antenna assembly to transmit and receive signals simultaneously with minimum signal interference. In this case, the number of faces/sides are reduced from eight in the embodiments of FIGS. 2A and 2B to six, nevertheless, the same hemispherical multibeam coverage is achieved. In some embodiments, the housing is a frame similar to the frame depicted in FIG. 3B.

Similar to the embodiments in FIGS. 2A, 2B, 3A and 3B, although two transmit AESA panels (with electronic circuitry) 606 and one receive AESA panel (with electronic circuitry) 608 are shown on each transmit and receive side, respectively, one skilled in the art would recognize that the embodiments are not limited to this configuration and may have more or less than two AESA panels (with electronic circuitry) on each side. In some embodiments, the six face panels 602*a*-602*f* are secured in the housing 614 by a frame (similar to the one depicted in FIGS. 3A and 3B, but configured for a hexagonal housing). The frame and/or the housing 614 is compact, sturdy and light-weight, similar in general configuration to that depicted in FIGS. 3A and/or 3B. In some embodiments, the panel and/or the housing is comprised of light material, such as Aluminum, polymer, carbon fiber, or any other structurally sound material or combination thereof.

Electronic circuitry, printed circuit board (PCB) and other peripheral components of the AESA antenna array assembly may be accommodated inside of the housing 614, however, can be located elsewhere within the installation platform. In some embodiments, each of the transmit AESA panels and receive AESA panels are sized based on the desired operating frequency and scan angle/beam shape, and can be combined in any desired configuration as long as the transmit and receive AESA panels are mounted on separate sides (in the case of a housing on a face panel) and the AESA panels are offset by about 60 degrees.

As shown in FIG. 6A, each of the six face panels 602*a*-602*f* forms a cant angle β with a vertical axis. This cant angle represents the cant angle of the face panels and may be anywhere from zero degrees (no canting) up to 45 degrees or more. The cant angle allows for full hemispherical coverage for operation with an AESA antenna panel that has practical limitations on the elevation scan angle. In some embodiments, a frame (similar to the frame depicted in FIG. 3B) may replace the housing (similar to the housing shown in FIG. 3A, but with six sides, each at a 60 Degree angle with one another).

Figure 4:
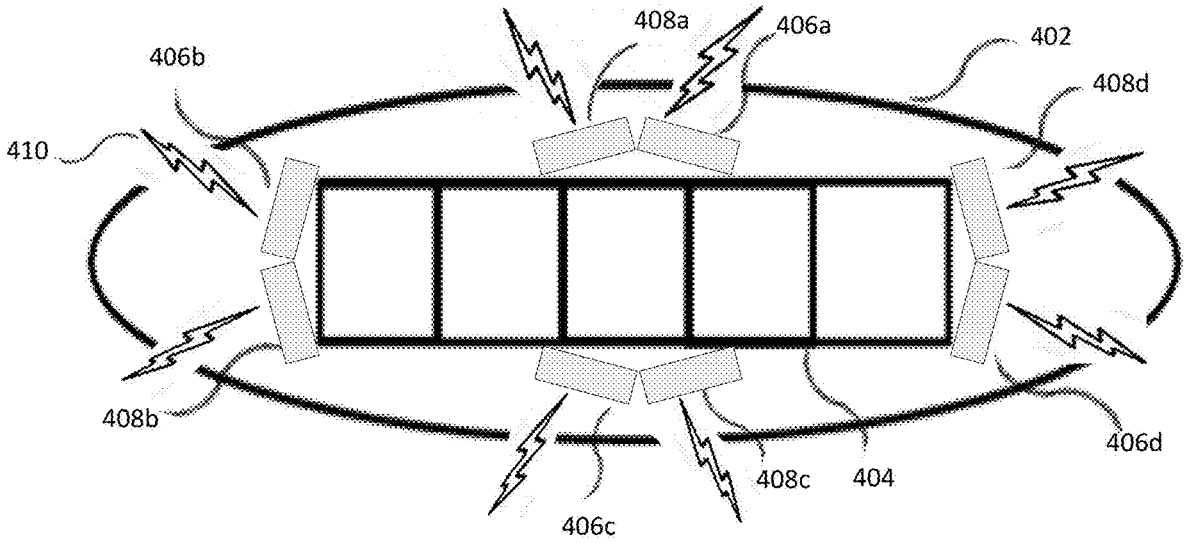
FIG. 4 depicts an AESA antenna array assembly subdivided to fit into an exemplary container or pod, according to some embodiments of the disclosed invention.

FIG. 4 depicts an AESA antenna array assembly in an exemplary container or pod, according to some embodiments of the disclosed invention. This configuration is useful when the entire AESA antenna array assembly cannot fit into the desired installation platform and needs to be "subdivided" into sections (of for example, four pairs of transmit and receive panels) to be accommodated in the container. As shown, the container or pod 402 accommodates a trellis frame 404 therein. The trellis frame 404 support four transmit AESA panels 408*a*-408*d* and four receive AESA panels 406*a*-406*d*. As explained above, with respect to FIGS. 2A-3B, the transmit AESA panels and the receive AESA panels alternate in their positions and each pair has the 45 degree offset between adjacent transmit AESA panel and receive AESA panel. The placement of the transmit AESA panels and receive AESA panels alternate (transmit, receive, transmit, receive, etc.) around the perimeter of the container or pod and like AESA panels on different sides are not adjacent to each other. The communication links, indicated by the lightning bolts 410 in FIG. 4, are representative of a multitude of bi-directional full-duplex terrestrial line-of-sight communication links or channels with electronically steered beams pointed at remote platforms (e.g. cellular, military common data link communications, and the like.)

Figure 5A:
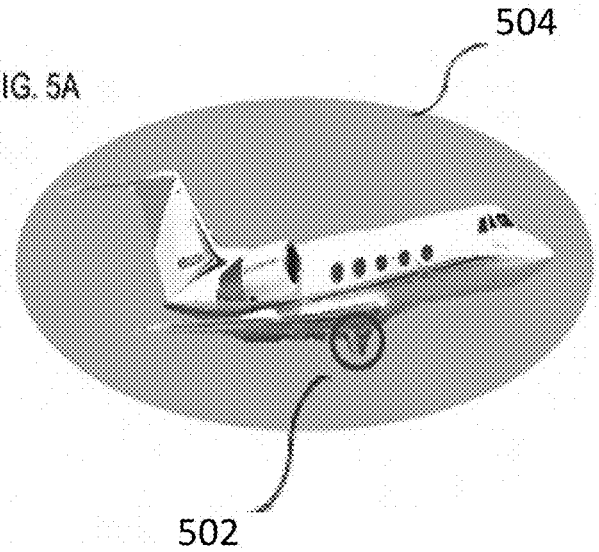
FIGS. 5A, 5B and 5C show some application examples of an AESA antenna array assembly, according to some embodiments of the disclosed invention.
Figure 5B:
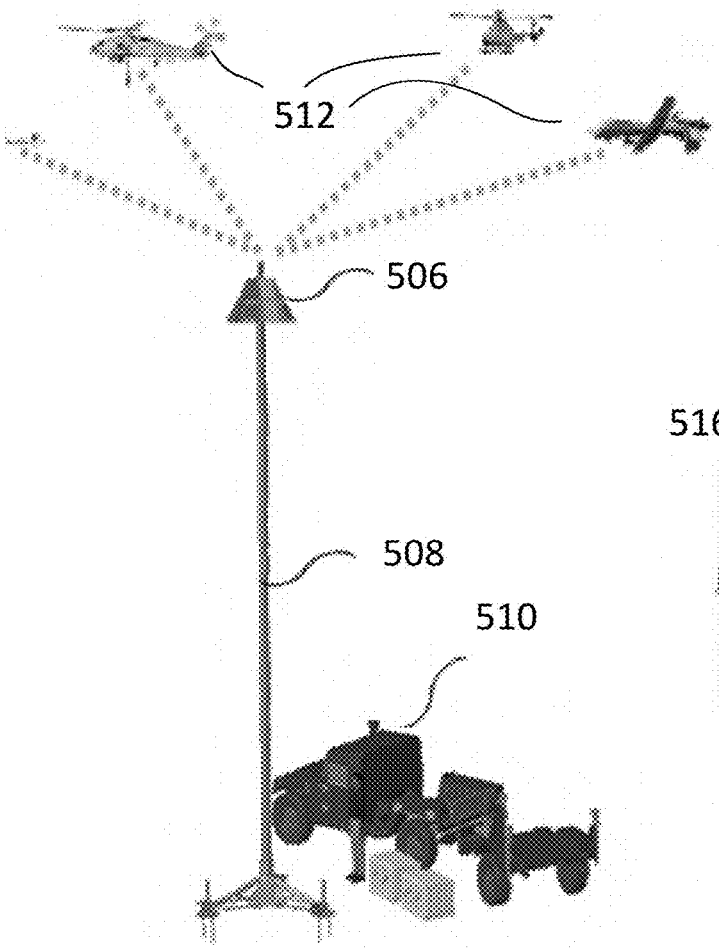
Figure 5C:
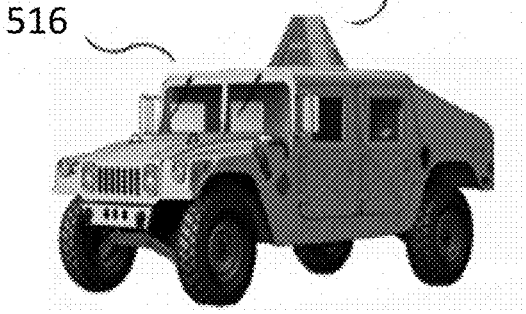

FIGS. 5A, 5B and 5C show some application examples of an AESA antenna array assembly, according to some embodiments of the disclosed invention. FIG. 5A shows an AESA antenna array assembly 502 being mounted under an aircraft 504. This configuration provides full 360 degree, multibeam coverage to ground stations and other aircraft around the aircraft 504 replacing multiple conventional high gain antennas or single low gain antennas with limited performance.

FIG. 5B illustrates an AESA antenna array assembly 506 being mounted on a pole/tower or a building 508 for communication between a ground station 510 and a variety of different platforms, such as aircrafts, unmanned aerial vehicles (UAVs), and/or ships, which also provides full 360 degree, multibeam coverage.

FIG. 5C shows an AESA antenna array assembly 514 being mounted on top of a vehicle 516 providing a mobile communications hub station or control station with full 360 degree, multibeam coverage.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

The invention claimed is:

1. An active electronically scanned array (AESA) antenna configuration for simultaneous transmission and receiving of communication signals comprising:

a housing having eight sides and an octagonally-shaped footprint at one end;

a first transmit AESA panel including transmit electronic circuitry and no receive electronic circuitry, mounted on a first side of the housing;

a first receive AESA panel including receive electronic circuitry and no transmit electronic circuitry, mounted on a second side of the housing adjacent to the first transmit AESA panel and forming an angle of about 45 degrees with the first transmit AESA panel;

a second transmit AESA panel including transmit electronic circuitry and no receive electronic circuitry, mounted on a third side of the housing adjacent to the first receive AESA panel and forming an angle of about 45 degrees with the first receive AESA panel;

a second receive AESA panel including receive electronic circuitry and no transmit electronic circuitry, mounted on a fourth side of the housing adjacent to the second AESA transmit panel and forming an angle of about 45 degrees with the second AESA transmit panel;

a third transmit AESA panel including transmit electronic circuitry and no receive electronic circuitry, mounted on a fifth side of the housing adjacent to the second AESA receive panel and forming an angle of about 45 degrees with the second AESA receive panel;

a third receive AESA panel including receive electronic circuitry and no transmit electronic circuitry, mounted on a sixth side of the housing adjacent to the third transmit AESA panel and forming an angle of about 45 degrees with the third AESA transmit panel;

a fourth transmit AESA panel including transmit electronic circuitry and no receive electronic circuitry, mounted on a seventh side of the housing adjacent to the third receive AESA panel and forming an angle of about 45 degrees with the third receive AESA panel; and a fourth receive AESA panel including receive electronic circuitry and no transmit electronic circuitry, mounted on an eight side of the housing adjacent to the fourth transmit AESA panel and the first transmit AESA panel, and forming an angle of about 45 degrees with fourth transmit AESA panel and the first transmit AESA panel at a respective side thereof, wherein each of the transmit and receive AESA panels are tilted by a cant angle with respect to a vertical axis of the antenna configuration, and wherein no AESA transmit panel is adjacent to another AESA transmit panel and no AESA receive panel is adjacent to another AESA receive panel on two different sides of the housing, and wherein the transmit and receive AESA panels simultaneously operate in a same frequency band;

wherein each of the receive AESA panels includes one receive electronic circuitries for simultaneous receiving of communication signals, and each of the transmit AESA panels includes two transmit electronic circuitry for transmission of a communication signal.

2. The AESA antenna configuration of claim 1, wherein the cant angle is in a range of more than zero to 45 degrees to form a cone-shaped housing having a tapered cross section from the top to the bottom in the vertical direction.

3. The AESA antenna configuration of claim 1, wherein the housing is a frame.

4. The AESA antenna configuration of claim 1, each of the transmit AESA panels includes a plurality of transmit electronic circuitries for simultaneous transmitting of a plurality of communication signals.

5. The AESA antenna configuration of claim 1, further comprising a frame for securing the transmit and receive AESA panels within the housing.

6. The AESA antenna configuration of claim 5, wherein the frame includes mounting structures for attaching peripheral electronics assemblies.

7. The AESA antenna configuration of claim 5, wherein the frame is a trellis frame.

8. The AESA antenna configuration of claim 5, wherein the housing is sub-divided into four separate sections of transmit and receive AESA panels, each section positioned at a distance from an adjacent section to accommodate the antenna configuration in a container or pod.

9. The AESA antenna configuration of claim 1, further comprising an opening at the bottom of the housing in the vertical direction for mounting features or location of a maintenance hatch.

10. The AESA antenna configuration of claim 9, wherein a shape of the opening is circular, elliptical, square or rectangular.

11. The AESA antenna configuration of claim 1 mounted on an aircraft, a pole, a tower, a vehicle or a building.

12. The AESA antenna configuration of claim 1, wherein each of the transmit electronic circuitry and the receive electronic circuitry includes one or more printed circuit boards (PCBs) and peripheral components accommodated inside of the housing.

13. An active electronically scanned array (AESA) antenna configuration for simultaneous transmission and receiving of communication signals comprising:

a housing having six sides and a hexagonally-shaped footprint at one end;

a first transmit AESA panel including transmit electronic circuitry and no receive electronic circuitry, mounted on a first side of the housing;

a first receive AESA panel including receive electronic circuitry and no transmit electronic circuitry, mounted on a second side of the housing adjacent to the first transmit AESA panel and forming an angle of about 60 degrees with the first transmit AESA panel;

a second transmit AESA panel including transmit electronic circuitry and no receive electronic circuitry, mounted on a third side of the housing adjacent to the first receive AESA panel and forming an angle of about 60 degrees with the first receive AESA panel;

a second receive AESA panel including receive electronic circuitry and no transmit electronic circuitry, mounted on a fourth side of the housing adjacent to the second transmit AESA panel and forming an angle of about 60 degrees with the second transmit AESA panel;

a third transmit AESA panel including transmit electronic circuitry and no receive electronic circuitry, mounted on a fifth side of the housing adjacent to the second receive AESA panel and forming an angle of about 60 degrees with the second receive AESA panel; and a third receive AESA panel including receive electronic circuitry and no transmit electronic circuitry, mounted on a sixth side of the housing adjacent to the third transmit AESA panel and forming an angle of about 60 degrees with the third transmit AESA panel and the first transmit panel at a respective side thereof, wherein each of the transmit and receive AESA panels are tilted by a cant angle with respect to a vertical axis of the antenna configuration, and wherein no AESA transmit panel is adjacent to another AESA transmit panel and no AESA receive panel is adjacent to another AESA receive panel on two different sides of the housing, and wherein the transmit and receive AESA panels simultaneously operate in a same frequency band;

wherein each of the receive AESA panels includes one receive electronic circuitries for simultaneous receiving of communication signals, and each of the transmit AESA panels includes two transmit electronic circuitry for transmission of a communication signal.

14. The AESA antenna configuration of claim 13, wherein the cant angle is in a range of more than zero to 45 degrees to form a cone-shaped housing having a tapered cross section from the top to the bottom in the vertical direction.

15. The AESA antenna configuration of claim 13, each of the transmit AESA panels includes a plurality of transmit electronic circuitries for simultaneous transmitting of a plurality of communication signals.

16. The AESA antenna configuration of claim 13, further comprising an opening at the bottom of the housing in the vertical direction for mounting features or location of a maintenance hatch.

17. The AESA antenna configuration of claim 16, wherein a shape of the opening is circular, elliptical, square or rectangular.

18. The AESA antenna configuration of claim 13 mounted on an aircraft, a pole, a tower, a vehicle or a building.

* * * * *